US005795852A

United States Patent [19]

He et al.

[11] Patent Number: 5,795,852

[45] Date of Patent: *Aug. 18, 1998

[54] BAR COMPOSITION COMPRISING NONIONIC POLYMERIC SURFACING AS MILDNESS ENHANCEMENT AGENTS

[75] Inventors: Mengtao He, Wayne; Michael Fair, Hackensack, both of N.J.; Michael Massaro, Congers, N.Y.

[73] Assignee: Lever Brothers Company, Division of Conopco, Inc., New York, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 637,145

[22] Filed: Apr. 24, 1996

[51] Int. Cl.[6] ..... C11D 17/00; C11D 9/32

[52] U.S. Cl. ..... 510/151; 510/152; 510/154; 510/155; 510/156; 510/141

[58] Field of Search ..... 510/152, 154, 510/155, 156, 141, 151

[56] References Cited

U.S. PATENT DOCUMENTS

| | | | |
|---|---|---|---|
| 3,312,627 | 4/1967 | Hooker | 252/152 |
| 3,766,097 | 10/1973 | Rosmarin | 252/552 |
| 4,247,425 | 1/1981 | Egan et al. | 252/548 |
| 4,256,611 | 3/1981 | Egan et al. | 252/548 |
| 4,343,726 | 8/1982 | Egan et al. | 252/547 |
| 5,520,840 | 5/1996 | Massaro et al. | 252/174.17 |
| 5,540,854 | 7/1996 | Fair et al. | 510/152 |
| 5,543,072 | 8/1996 | Fost et al. | 510/151 |

FOREIGN PATENT DOCUMENTS

| | | |
|---|---|---|
| 311343 | 10/1987 | European Pat. Off. . |
| 91/09106 | 6/1991 | WIPO . |
| 93/04161 | 8/1991 | WIPO . |
| 93/17088 | 2/1992 | WIPO . |
| 92/13060 | 8/1992 | WIPO . |
| 93/04161 | 3/1993 | WIPO . |
| 93/17088 | 9/1993 | WIPO . |
| 94/17172 | 8/1994 | WIPO . |
| 94/21778 | 9/1994 | WIPO . |

OTHER PUBLICATIONS

International Search Report No. PCT/EP 97/01148 dated Aug. 27, 1997.

*Primary Examiner*—Paul Lieberman
*Assistant Examiner*—Necholus Ogden
*Attorney, Agent, or Firm*—Ronald A. Koatz

[57] ABSTRACT

The present invention is directed to synthetic bar compositions wherein relatively small amounts of specified hydrophobically modified polyalkylene glycol nonionic polymer has been found to enhance mildness of bar compositions without sacrificing processability and lather property.

13 Claims, 3 Drawing Sheets

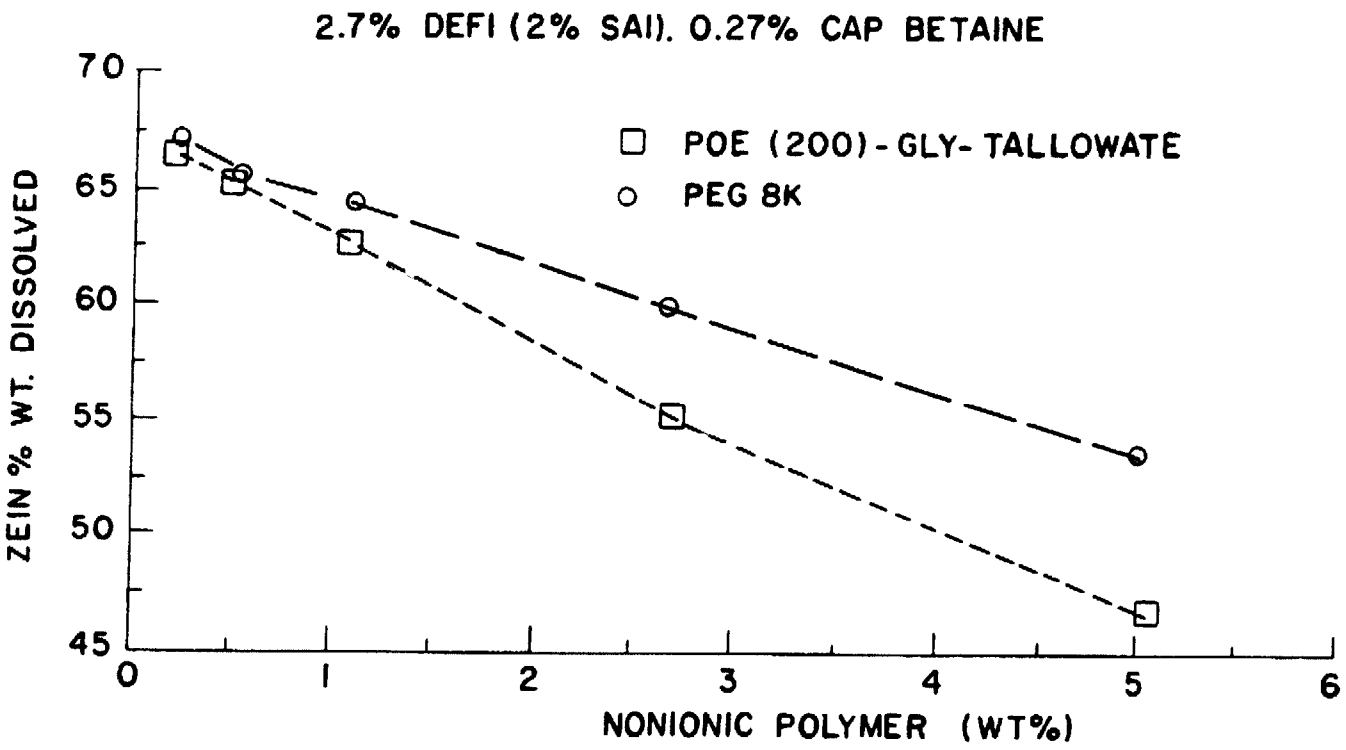
FIG. Ib

BAR COMPOSITION COMPRISING NONIONIC POLYMERIC SURFACING AS MILDNESS ENHANCEMENT AGENTS

FIELD OF THE INVENTION

The present invention relates to synthetic bar compositions (i.e., bars in which at least some fatty acid soap has been replaced by synthetic surfactants, such as synthetic anionic surfactants).

BACKGROUND

Traditionally, soap has been utilized as a skin cleanser. Notwithstanding its many advantages (e.g., inexpensive, easy to manufacture into bars, having good lathering properties), soap is a very harsh chemical. Irritated and cracked skin often result from the use of soap, especially in colder climates.

In order to maintain cleaning effectiveness and reduce harshness, the art has used synthetic surfactants to replace some or all of the soap. In particular, anionic surfactants have been used because these tend to most clearly mimic the lather generation which soap readily provides.

Anionic surfactants, however, are still harsh. One method of reducing the harshness of anionic surfactants is to utilize other surfactants such as nonionic or other mildness surfactants (e.g., amphoteric). The use of surfactants other than anionics, however, can introduce other problems. For example, nonionic surfactants generally do not generate creamy thick lather as do anionics; and both nonionics and amphoterics, for example can be sticky and introduce processing difficulties.

For this reason, the art is always searching for materials which are milder than anionic and/or which can be used to replace at least some of the anionic surfactants, yet, which do not simultaneously seriously compromise lather generation or processing efficiency. Further, even if the anionic is not substituted, the art is always searching for materials which can substitute for inerts and/or other fillers and produce enhanced mildness.

Unexpectedly, applicants have found that the use of relatively low levels of specific nonionic polymeric surfactants can be used to obtain these goals. That is, even at relatively low level of addition of nonionic polymeric surfactant (nonionic polymeric surfactant to anionic surfactant weight ratio below 1:1), the specified nonionic polymeric surfactants were found to significantly mitigate the skin irritation of anionic surfactants without sacrificing processability and lather. At weight ratios above 1:1, the bar processability can be negatively affected; for example, formulation can become highly viscous and sticky to cause extrusion difficulties. While not wishing to be bound by theory, it is believed that the hydrophobically modified nonionic polymers may be interacting with anionic surfactant to form polymer-surfactant complexes thereby reducing free anionic surfactant (known for its harshness) from the bar.

The use of hydrophobically modified polyethylene glycol (HMPEG) nonionic polymeric surfactants in bar compositions per se is not new.

U.S. Pat. No. 3,312,627 to Hooker, for example, teaches bars substantially free of anionic detergents comprising 0 to 70% by weight of polyethylene glycol (PEG) or hydrophobically modified derivatives of these compounds as base; and 10 to 70% of a nonionic lathering component. In order to give these bars more "soap-like" characteristics, the reference contemplates use of 10%–80% lithium soap. It is clear that use of lithium soap is unique to the invention (column 8, lines 20–23) and that use of other soaps or anionic (other than fatty acid lithium soap) is not contemplated. Thus, this reference clearly differs from the composition of the invention which comprise 10 to 70% of a surfactant system of which at least 50% (though no more than 60% total of total composition) is synthetic anionic surfactant.

World Patent No. WO 9317088 to Procter & Gamble claims a soap-based bar substantially free of synthetic anionic detergents comprising 45–90% fatty acid soap, 18% $C_{14-20}E_{65-100}$ as coactive, and 0.5–2% cationic polymer as mildness aid. The formulation had an improved scum control.

World Patent No. WO 9304161 to Procter & Gamble claims soap-based bar formulations substantially free of synthetic anionic detergents comprising 45–90% fatty acid soap, 0.5–10% $C_{14-20}E_{20-250}$ (preferably $C_{14-20}E_{25-80}$) as coactive, and 0.5–10% acyl isethionate surfactant. The addition of small amounts of ethoxylated nonionic surfactant was to reduce the scum formation.

European Patent No. EP 311,343 to G. Dawson and G. Ridley teaches a Betaphase toilet soap bar substantially free of synthetic anionic detergents comprising 45–90% of soluble alkali metal soap of C8–C24 fatty acids, 0.5–45% of an ethoxylated nonionic surfactant having an HLB of 12–19.5, and 0.01 to 5% of a water-soluble polymer. The composition has improved scum control with good mildness, lathering, and transparency.

U.S. Pat. Nos. 4,247,425, 4,343,726, and 4,256,611 to R. Egan teach liquid skin cleansing formulations containing anionic surfactant and hydrophobically modified polyalkylene glycols as mildness enhancers. These patents showed that only at relatively high addition level of the hydrophobically modified polyalkylene glycols (hydrophobically modified polyalkylene glycols/anionic surfactant weight ratio above 1:1 (preferably 1:1 to 4:1)), the hydrophobically modified polyalkylene glycols can significantly reduce the irritation of anionic surfactant.

In contrast, our in-vivo and in-vitro tests showed that at much lower level of addition of hydrophobically modified polyalkylene glycols (weight ratio well below 1:1), the alkylene oxide adduct of our choice can still significantly reduce the skin irritation potential of anionic surfactant. This low addition level is a criticality, because at higher level of addition, defined hydrophobically modified polyalkylene glycols can make bar formulation sticky and viscous thereby causing processing problems, such as difficulties during extrusion and stamping.

BRIEF SUMMARY OF THE INVENTION

Applicants have now found that the use of relatively small amounts of defined hydrophobically modified polyethylene glycol (HMPEG) nonionic polymer surfactants in bar compositions comprising primarily synthetic anionic surfactant systems remarkably and unexpectedly enhances the mildness of these bars.

More specifically, applicants' invention relates to bar compositions comprising:

(a) 10% to 70% by wt. total composition of a surfactant system selected from the group consisting of anionic surfactants, nonionic surfactants (other than the hydrophobically modified polyethylene glycols), cationic surfactants, amphoteric surfactants and mixtures thereof;

wherein the anionic surfactant comprises at least 50%, preferably at least 60% of said surfactant system and wherein the anionic component further comprises no more than about 60% by wt. of total composition;

(b) 20% to 85% by wt., preferably 30 to 70% total composition of a bar structurant selected from the group consisting of alkylene oxide compounds having a molecular weight of from about 2000 to about 25,000, preferably 3,000 to 10,000; $C_8$–$C_{22}$ free fatty acids, paraffin waxes; water soluble starches (e.g., maltodextrin); and $C_8$–$C_{20}$ alkanols; and (c) 2% to 30% by wt. total composition of a hydrophobically modified polyethylene glycol (HMPEG);

wherein the weight ratio of HMPEG to anionic surfactant is between 1:1.5 to 1:10, preferably 1:3 to 1:7. Above the range of this weight ratio, bar processability can be negatively affected, e.g., increased stickiness causes plodding and stamping difficulties; below the range of this ratio, the skin irritation of anionic surfactants can not be effectively mitigated.

The composition may optionally comprise 0% to 25%, preferably 2% to 15% by wt. solvent such as ethylene oxide or propylene oxide.

BRIEF DESCRIPTION OF THE FIGURES

FIG. 1*a* and FIG. 1*b* shows the Zein % dissolved by acyl isethionate/cocoamidopropyl betaine as a function of nonionic polymeric surfactant concentration. In contrast to PEG 8000, POE(200) glyceryl stearate and POE(200) glyceryl tallowate significantly reduced the Zein % dissolved at relatively low levels. Therefore the irritation potential of a personal washing bar can be further reduced by including relatively low levels (i.e., HMPEG: anionic weight ratio below 1:1) of defined hydrophobically modified polyalkylene glycols in a full bar composition.

DETAILED DESCRIPTION OF THE INVENTION

Figure 1A:
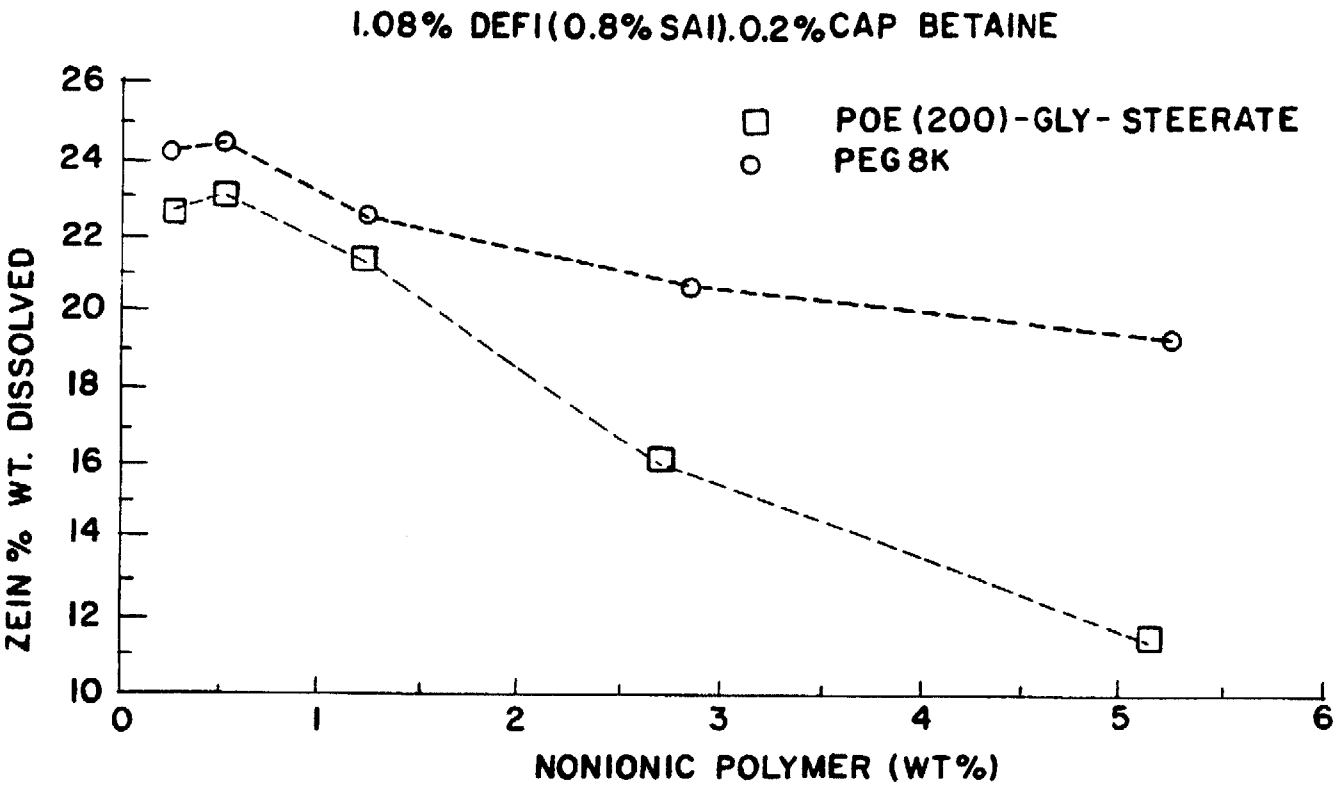

The present invention relates to synthetic bar compositions wherein the majority of the surfactant system of the bar comprises synthetic anionic surfactant; and to specific hydrophobically modified polyalkylene glycols which can be used in such bar compositions at relatively low addition levels to significantly enhance bar mildness without sacrificing processability and lather.

More specifically, the bar compositions comprise (a) 10% to 70% by weight total composition of a surfactant system wherein said surfactant system is selected from the group consisting of anionic surfactants, nonionic surfactants (other than the EO-PO polymer), amphoteric surfactants, cationic surfactants and mixtures thereof, wherein the anionic comprises 50% or more, preferably 60% or more, of the surfactant system and the anionic further comprises no more than 60% of the total composition;

(b) 20% to 85% by wt. total composition of a bar structurant selected from the group consisting of polyalkylene glycols having a MW of from about 2,000 to 25,000 (which may optionally include 1% to 5% higher molecular weight polyalkylene glycols having MW from 50,000 to 500,000, especially around 100,000); $C_8$ to $C_{24}$, preferably $C_{12}$ to $C_{24}$ fatty acids; paraffin waxes; water soluble starches (e.g., maltodextrin); and $C_8$ to $C_{20}$ alkanols (e.g., cetyl alcohol); and (c) 2% to 30% by weight total composition of a hydrophobically modified polyalkylene glycol nonionic polymer surfactant wherein weight ratio of hydrophobically modified polyalkylene glycol to anionic surfactant is between 1:1.5 to 1:10, preferably 1:3 to 1:7. Above the range of this weight ratio, bar processability can be negatively affected, e.g., increased stickiness may cause plodding and stamping difficulties; below the range of this ratio, the skin irritation of anionic surfactants can not be effectively mitigated.

Surfactant System

The anionic detergent active which may be used may be aliphatic sulfonates, such as a primary alkane (e.g., $C_8$–$C_{22}$) sulfonate, primary alkane (e.g., $C_8$–$C_{22}$) disulfonate, $C_8$–$C_{22}$ alkene sulfonate, $C_8$–$C_{22}$ hydroxyalkane sulfonate or alkyl glycerol ether sulfonate (AGS); or aromatic sulfonates such as alkyl benzene sulfonate.

The anionic may also be an alkyl sulfate (e.g., $C_{12}$–$C_{18}$ alkyl sulfate) or alkyl ether sulfate (including alkyl glycerol ether sulfates). among the alkyl ether sulfates are those having the formula:

$$RO(CH_2CH_2O)_nSO_3M$$

wherein R is an alkyl or alkenyl having 8 to 18 carbons, preferably 12 to 18 carbons, n has an average value of greater than 1.0, preferably greater than 3; and M is a solubilizing cation such as sodium, potassium ammonium or substituted ammonium. Ammonium and sodium lauryl ether sulfates are preferred.

The anionic may also be alkyl sulfosuccinates (including mono- and dialkyl, e.g., $C_6$–$C_{22}$ sulfosuccinates); alkyl and acyl taurates, alkyl and acyl sarcosinates, sulfoacetates, $C_8$–$C_{22}$ alkyl phosphates and phosphates, alkyl phosphate esters and alkoxyl alkyl phosphate esters, acyl lactates, $C_8$–$C_{22}$ monoalkyl succinates and maleates, sulphoacetates, alkyl glucosides and acyl isethionates.

Sulfosuccinates may be monoalkyl sulfosuccinates having the formula:

$$R^4O_2CCH_2CH(SO_3M)CO_2M; \text{ and}$$

amide-MEA sulfosuccinates of the formula:

$$R^4CONHCH_2CH_2O_2CCH_2CH(SO_3M)CO_2M$$

wherein $R^4$ ranges from $C_8$–$C_{22}$ alkyl and M is a solubilizing cation.

Sarcosinates are generally indicated by the formula:

$$R'CON(CH_3)CH_2CO_2M,$$

wherein R ranges from $C_8$–$C_{20}$ alkyl and M is a solubilizing cation.

Taurates are generally identified by formula:

$$R^2CONR^3CH_2CH_2SO_3M$$

wherein $R^2$ ranges from $C_8$–$C_{18}$ alkyl, $R^3$ ranges from $C_1$–$C_4$ a alkyl and M is a solubilizing cation.

Particularly preferred are the $C_8$–$C_{18}$ acyl isethionates. These esters are prepared by reaction between alkali metal isethionate with mixed aliphatic fatty acids having from 6 to 18 carbon atoms and an iodine value of less than 20. At least 75% of the mixed fatty acids have from 12 to 18 carbon atoms and up to 25% have from 6 to 10 carbon atoms.

Acyl isethionates, when present, will generally range from about 10% to about 70% by weight of the total composition. Preferably, this component is present from about 30% to about 60%.

The acyl isethionate may be an alkoxylated isethionate such as is described in Iiardi et al., U.S. Pat. No. 5,393,466, hereby incorporated by reference. This compound has the general formula:

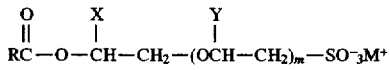

wherein R is an alkyl group having 8 to 18 carbons, m is an integer from 1 to 4, X and Y are hydrogen or an alkyl group having 1 to 4 carbons and $M^+$ is a monovalent cation such as, for example, sodium, potassium or ammonium.

The anionic surfactant comprises 50% or more of the total surfactant system, but should comprise no more than 40% by wt. of the total composition.

Amphoteric detergents which may be used in this invention include at least one acid group. This may be a carboxylic or a sulphonic acid group. They include quaternary nitrogen and therefore are quaternary amido acids. They should generally include an alkyl or alkenyl group of 7 to 18 carbon atoms. They will usually comply with an overall structural formula.

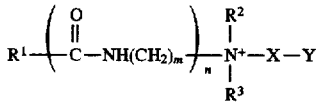

where $R^1$ is alkyl or alkenyl of 7 to 18 carbon atoms;

$R^2$ and $R^3$ are each independently alkyl, hydroxyalkyl or carboxyalkyl of 1 to 3 carbon atoms;

m is 2 to 4;

n is 0 to 1;

X is alkylene of 1 to 3 carbon atoms optionally substituted with hydroxyl, and

Y is $—CO_2—$ or $—SO_3—$

Suitable amphoteric detergents within the above general formula include simple betaines of formula:

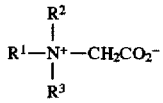

and amido betaines of formula:

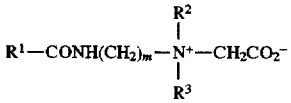

wherein m is 2 or 3.

In both formulae $R^1$, $R^2$, and $R^3$ are as defined previously. $R^1$ may in particular be a mixture of $C_{12}$ and $C_{14}$ alkyl groups derived from coconut so that at least half, preferably at least three quarters of the groups $R^1$ are preferably methyl.

A further possibility is that the amphoteric detergent is a sulphobetaine of formula

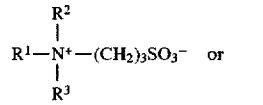

wherein m is 2 or 3, or variants of these in which $—(CH_2)_3SO_3$ is replaced by

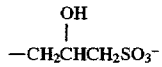

In these formulae $R^1$, $R^2$ and $R^3$ are as discussed previously.

The nonionic which may be used includes in particular the reaction products of compounds having a hydrophobic group and a reactive hydrogen atom, for example aliphatic alcohols, acids, amides or alkyl phenols with alkylene oxides, especially ethylene oxide either alone or with propylene oxide. Specific nonionic detergent compounds are alkyl ($C_6$–$C_{22}$) phenols-ethylene oxide condensates, the condensation products of aliphatic ($C_8C_{18}$) primary or secondary linear or branched alcohols with ethylene oxide, and products made by condensation of ethylene oxide with the reaction products of propylene oxide and ethylenediamene Other so-called nonionic detergent compounds include long chain tertiary amine oxides, long chain tertiary phosphine oxides and dialkyl sulphoxides.

The nonionic may also be a sugar amide, such as a polysaccharide amide. Specifically, the surfactant may be one of the lactobionamides described in U.S. Pat. No. 5,389,279 to Au et al. which is hereby incorporated by reference or it may be one of the sugar amides described in U.S Pat. No. 5,009,814 to Kelkenberg, hereby incorporated into the subject application by reference.

Other surfactants which may be used are described in U.S. Pat. No. 3,723,325 to Parran Jr. which is also incorporated into the subject application by reference.

Nonionic and cationic surfactants which may be used include any one of those described in U.S. Pat. No. 3,761,418 to Parran, Jr. hereby incorporated by reference into the subject application. Those included are the aldobionamides taught in U.S. Pat. No. 5,389,279 to Au et al. and the polyhydroxy fatty acid amides as taught in U.S. Pat. No. 5,312,934 to Lefton, both of which are incorporated by reference into the subject application.

The surfactants generally comprise 10 to 50% of the total composition except, as noted that anionic comprises 50% or more of the surfactant system and no more than 40% total.

A preferred surfactant system is one comprising acyl isethionate and a amphoteric, i.e., betaine, as co-surfactant.

Structurant

The structurant of the invention can be a water soluble or water insoluble structurant.

Water soluble structurants include moderately high molecular weight polyalkylene oxides of appropriate melting point (e.g., 40° to 100° C., preferably 50° to 90°) and in particular polyethylene glycols or mixtures thereof.

Polyethylene glycols (PEG's) which are used may have a molecular weight in the range 2,000 to 25,000, preferably 3,000 to 10,000. However, in some embodiments of this invention it is preferred to include a fairly small quantity of polyethylene glycol with a molecular weight in the range from 50,000 to 500,000, especially molecular weights of around 100,000. Such polyethylene glycols have been found to improve the wear rate of the bars. It is believed that this is because their long polymer chains remain entangled even when the bar composition is wetted during use.

If such high molecular weight polyethylene glycols (or any other water soluble high molecular weight polyalkylene oxides) are used, the quantity is preferably from 1% to 5%, more preferably from 1% or 1.5% to 4% or 4.5% by weight of the composition. These materials will generally be used jointly with a large quantity of other water soluble structurant such as the above mentioned polyethylene glycol of molecular weight 2,000 to 25,000, preferably 3,000 to 10,000.

Water insoluble structurants also have a melting point in the range 40°–100° C., more preferably at least 50° C., notably 50° C. to 90° C. Suitable materials which are particularly envisaged are fatty acids, particularly those having a carbon chain of 12 to 24 carbon atoms. Examples are lauric, myristic, palmitic, stearic, arachidic and behenic acids and mixtures thereof. Sources of these fatty acids are coconut, topped coconut, palm, palm kernel, babassu and tallow fatty acids and partially or fully hardened fatty acids or distilled fatty acids. Other suitable water insoluble structurants include alkanols of 8 to 20 carbon atoms, particularly cetyl alcohol. These materials generally have a water solubility of less than 5 g/liter at 20° C.

Soaps (e.g., sodium stearate) can also be used at levels of about 1% to 15%. The soaps may be added neat or made in situ by adding a base, e.g., NaOH, to convert free fatty acids.

The relative proportions of the water soluble structurants and water insoluble structurants govern the rate at which the bar wears during use. The presence of the water-insoluble structurant tends to delay dissolution of the bar when exposed to water during use and hence retard the rate of wear.

The structurant is used in the bar in an amount of 20% to 85%, preferably 30% to 70% by wt.

Hydrophobically Modified Polyalkylene Glycols

The hydrophobically modified polyalkylene glycols (HMPEG) of the subject invention are generally commercially available nonionic polymeric surfactants having a broad molecular weight range from about 3000 to 25000 (preferably 4000 to 15000) and a melting temperature of from about 25° to 85° C., preferably 40° to 65° C. Below the defined range of molecular weight, HMPEG can make bar formulations sticky and therefore cause processing problems, such as difficulties in extrusion and stamping. Above this range, HMPEG can make bar formulation highly viscous and may cause mixing difficulties.

Generally, the polymers will be selected from alkylene nonionic polymers chemically terminally attached by hydrophobic moieties. A detailed description of the hydrophobic moieties (R) is presented in Table 1. These polymers are usually commercially available.

To ensure water solubility, we prefer that the portion of ethylene oxide moiety per mole is between 60% wt. and 99% wt. (preferably 85% wt. to 97% wt.). In other words, the total content of the hydrophobic moiety is between 2% wt. and 30% wt. (preferably 3% wt. to 15% wt.) in each mole of hydrophobically modified alkylene glycol. The hydrophobic moiety (or moieties) may be derivatives of linear or branched alkyls, acyls, and aryl, alkylaryl, and alkenyls having 2 to 60 carbons, preferably 8 to 40 carbons. Detailed description of the hydrophobic moiety (moieties) is presented in Table 1.

Specifically, examples of various hydrophobically modified polyalkylene glycols are set forth in Table 1 below wherein $T_m$(°C.) were digested from literature from the corresponding chemical suppliers or measured by the inventors using a differential scanning calorimetry technique.

Table 1 Representative hydrophobically modified PEGs.

(R=hydrophobic moieties, such as derivatives of alkyl, aryl, alkylaryl, alkylene, acyl; and fat and oil derivatives of alkylglyceryl, glyceryl, sorbitol, lanolin oil, coconut oil, jojoba oil, castor oil, almond oil, peanut oil, wheat germ oil, rice bran oil, linseed oil, apricot pits oil, walnuts, palm nuts, pistachio nuts, sesame seeds, rapeseed, cade oil, corn oil, peach pit oil, poppyseed oil, pine oil, soybean oil, avocado oil, sunflower seed oil, hazelnut oil, olive oil, grapeseed oil, and safflower oil, Shea butter, babassu oil, etc.;

POE=Polyoxyethylene or polyethylene glycol;

m=No. ethylene oxide monomer units; preferably m=m>40; more preferably m>50.)

| Chemicals | Suppliers (Brands) | Comments |
|---|---|---|
| POE(m)-R | Witco (Varonic LI-420) | R = glyceryltallowate; m = 200; white solid. |
| | Seppic (Simusol 220TM) | R = glycerylstearate; m = 200; white solid. |
| | Amerchol (Glucam E-200) | R = glucoside; m =200; white solid. water soluble; white solid. |
| | Calgene Chemical (600-S) | Tm: 52–62C; R = stearate; m = 150; Tm: 52–62C. |
| | Calgene Chemical (600-L) | R = laurate; m = 150. |
| R-POE(m)-R | Stepan (KESSCO PEG6000 distearate) | R = stearate; m = 174; Tm: 54C; white solid. |

As noted, melting temperature of the compounds must be about 25° C.–85° C., preferably 40° C. to 65° C., the latter being more favorable for processing (e.g., chips form more easily and logs plod more readily).

Bars of the invention may comprise 0% to 25%, preferably 2% to 15% by wt. of an emollient such as ethylene glycol, propylene glycol and/or glycerine.

Other Ingredients

Bar compositions of this invention will usually contain water, but the amount of water is only a fairly small proportion of the bar. Larger quantities of water reduce the hardness of the bars. Preferred is that the quantity of water is not over 15% by weight of the bars, preferably 1% to about 10%, more preferably 3% to 9%, most preferably 3% to 8%.

Bars of this invention may optionally include so-called benefit agents—materials included in relatively small proportions which confer some benefit additional to the basic cleansing action of the bars. Examples of such agents are: skin conditioning agents, including emollients such as fatty alcohols and vegetable oils, essential oils, waxes, phospholipids, lanolin, anti-bacterial agents and sanitizers, opacifiers, pearlescers, electrolytes, perfumes, sunscreens, fluorescers and coloring agents. Preferred skin conditioning agents comprise silicone oils, mineral oils and/or glycerol.

The examples below are intended to better illustrate the invention, but are not intended to be limiting in any way.

All percentages, unless otherwise noted, are intended to be percentages by weight.

EXAMPLES

Methodology

Mildness Assessments

Zein dissolution test was used to preliminarily screen the irritation potential of the formulations studied. In an 8 oz. jar, 30 mLs of an aqueous dispersion of a formulation were prepared. The dispersions sat in a 45° C. bath until fully dissolved. Upon equilibration at room temperature, 1.5 gms of zein powder were added to each solution with rapid stirring for one hour. The solutions were then transferred to centrifuge tubes and centrifuged for 30 minutes at approximately 3,000 rpms. The undissolved zein was isolated, rinsed and allowed to dry in a 60° C. vacuum oven to a constant weight. The percent zein solubilized, which is proportional to irritation potential, was determined gravimetrically.

The Protocol of 3-Day Patch Test

Patch test was used to evaluate skin mildness of aqueous dispersions containing 1% DEFI active (sodium cocoyl isethionate) and different levels of the structurant/coactives. Patches (Hilltop® Chambers, 25 mm in size) were applied to the outer upper arms of the panelists under bandage type dressings (Scanpor® tape). After each designated contact periods (24 hrs. for the first patch application, 18 hrs. for the second and third applications), the patches were removed and the sites were visually ranked in order of severity (erythema and dryness) by trained examiners under consistent lighting.

Formulation Processing

Bar formulations were prepared in a 2-liter Patterson mixer with a sigma type blade. The components were mixed together at ~95° C., and the water level was adjusted to approximately 8–10 wt. %. The batch was covered to prevent moisture loss, and mixed for about 15 minutes. Then the cover was removed and the mixture was allowed to dry. The moisture content of the samples taken at different times during the drying stage was determined by Karl Fisher titration with a turbo titrator. At the final moisture level (~5%), the formulation was dropped onto a heated applicator roll and then was chipped over a chill roll. The chill roll chips were plodded under vacuum in a Weber Seelander duplex refiner with screw speed at ~20 rpm. The nose cone of the plodder was heated to 45°–50° C. The cut billets were stamped into bars using a Weber Seelander L4 hydraulic press with a nylon, pillow-shaped die in place.

Bars were also prepared by a cast-melt process. First, the components were mixed together at 80°–120° C. in a 500 ml beaker, and the water level was adjusted to approximately 10–15 wt. %. The batch was covered to prevent moisture loss and was mixed for about 15 minutes. Then the cover was removed, and the mixture was allowed to dry. The moisture content of the samples taken at different times during the drying stage and was determined by Karl Fisher titration with a turbo titrator. At the final moisture level (~5%), the mixture in the beaker (in the form of a free-flow liquid) was dropped into bar-molds and was allowed to be cooled at room temperature for four hours. Upon solidification, the mixture was casted in the bar mold into a bar.

Example 1

Components as listed in Table 2 below were melted together at 80° C.–120° C. to produce a material consisting predominantly of a liquid phase. All amounts are provided in percentage by weight. On cooling to 10° C.–50° C. by a chill-roll, the formulations formed plastic-like solids that were plodded using the extrusion equipment described above (i.e., formulation processing section) and pressed into bars using the single bar press. Identical formulations were also formed into bars by using the casting process from the hot melt. These bars contain a major DEFI active and an optional cocoamidopropyl betaine coactive. These bars provided rich, creamy and slippery lather; the skin-feel of the bars were found to be smooth and non-tacky.

TABLE 2

| Formulation | A | B | C | D |
|---|---|---|---|---|
| Sodium acyl isethionate (from DEFI*) | 27.8% | 27.0% | 27.0% | 27.8% |
| Cocoamidopropyl betaine | 5.2 | 5.0 | 5.0 | 5.2 |
| PEG 8000** | 32.1 | 29.5 | 35.0 | 45.1 |
| PEG 4000*** | 3.1 | 0.0 | 0.0 | 0 |
| Stearic-palmitic acid | 11.6 | 8.6 | 9.0 | 11.6 |
| Maltodextrin | 10.3 | 10.0 | 0.0 | 4.4 |
| POE (200) glyceryl stearate | 4.0 | 5 | 10 | 0.0 |
| POE (200) glyceryl tallowate | 0 | 5 | 0 | 0 |
| Perfume | 0 | 0.3 | 0.3 | 0 |
| Sodium Stearate | 0 | 0 | 5.0 | 0 |
| Titanium Dioxide | 0 | 0 | 0.5 | 0 |
| EHDP | 0 | 0.1 | 0.1 | 0 |
| EDTA | 0 | 0.1 | 0.1 | 0 |
| Misc. Salts | 0 | 2.9 | 2.9 | 0 |
| Water | 5.9 | 6.5 | 5.1 | 5.9 |

*DEFI: directiy esterified fatty acid isethionate, which is a mixture containing about 74% by weight of fatty acyl isethionate, 23% stearic-palmitic acid and small amounts of other materials, manufactured by Lever Brothers Co., U. S.
**PEG 8000: polyoxyethylene glycol with mean molecular weigh at 8000; PEG 4000; polyoxyethylene glycol with mean molecular weight at 4000.

Example 2

Components as listed in Table 3 below were preferably processed using a cast-melt approach described in the methodology section. All amounts are given in percentage of weight. These bars used sodium lauryl sarcosinate (formulation E, G) and sodium lauryl sulphate (formulation F) as the major anionic detergent with optional cocoamidopropyl betaine as a coactive. These bars provided rich, creamy and slippery lather and smooth skin feel.

TABLE 3

| Formulation | (E) | (F) | (G) |
|---|---|---|---|
| Sodium Lauryl Sarcosinate | 15 | 0.0 | 27.0 |
| Cocoamidopropyl Betaine | 5.0 | 5.0 | 5.0 |
| SLES (3E0) | 5.0 | 20.0 | 0.0 |
| Stearic-palmitic Acid | 5.0 | 5.0 | 5.0 |
| PEG 8000 | 25.0 | 44.0 | 39.0 |
| PEG 6000 | 27.0 | 8.0 | 5.0 |
| POE (200) glyceryl stearate | 10.0 | 10.0 | 10.0 |
| Paraffin Wax | 2.0 | 2.0 | 3.0 |
| Perfumes | 1.0 | 1.0 | 1.0 |
| Water | 5.0 | 5.0 | 5.0 |

Example 3

The irritation reduction potential of hydrophobically modified polyalkylene glycols was investigated using Zein dissolution experiments. As indicated in FIG. 1*a* and FIG. 1*b*, the defined hydrophobically modified polyalkylene glycols, as a class, are significantly more effective than PEG in reducing the Zein % dissolved by 1% to 2% aqueous DEFI suspension (DEFI is a sodium acyl isethionate/fatty acid mixture defined in the Table 2 of Example 1). The data in FIG. 1*a* and FIG. 1*b* also showed that at relatively low level of addition of hydrophobically modified polyalkylene glycols (hydrophobically modified polyalkylene glycol to anionic surfactant weight ratio is below 1:1), hydrophobically modified polyalkylene glycols significantly reduced the amount of Zein dissolved by DEFI.

Example 4

Figure 2:
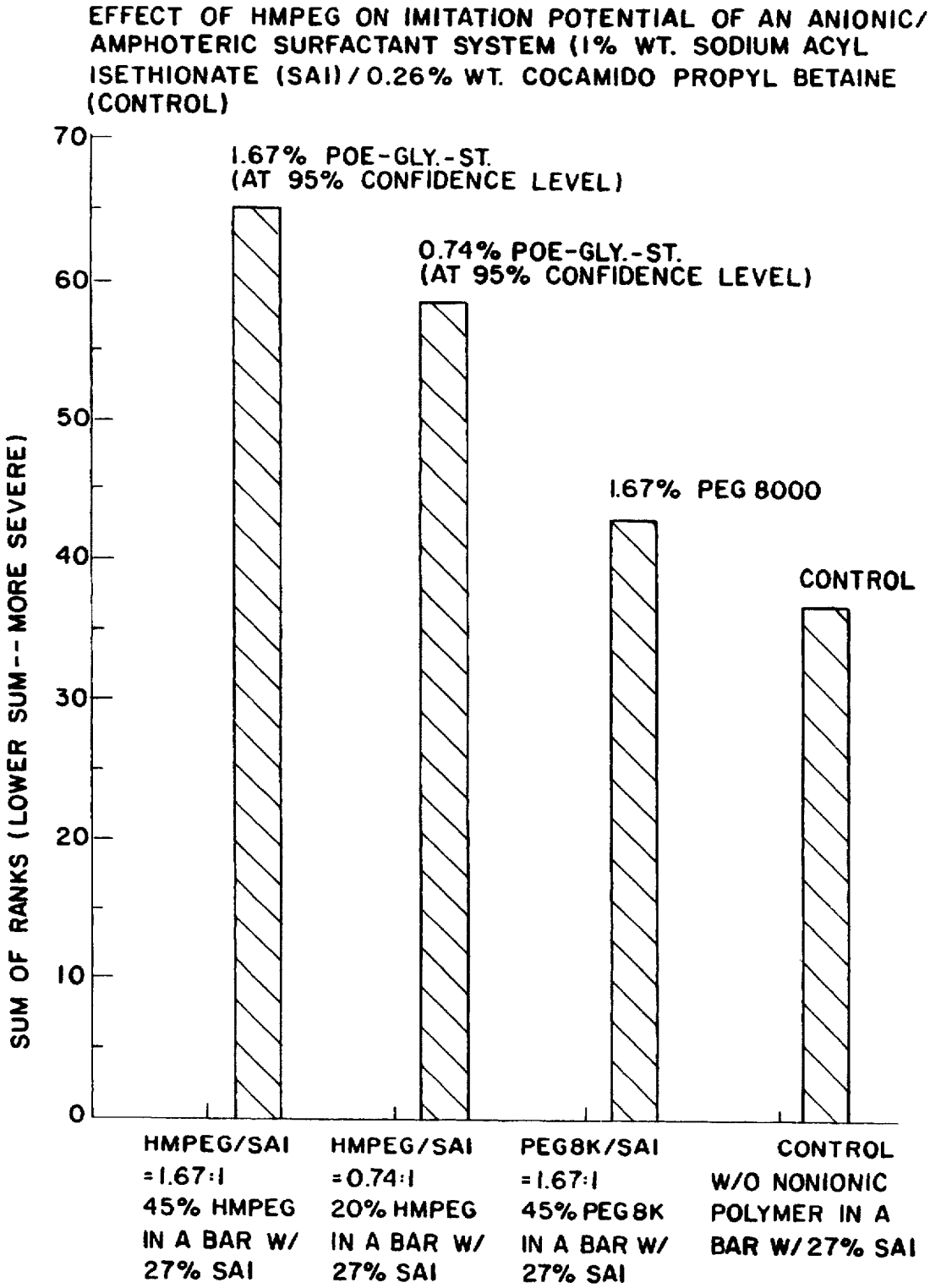
FIG. 2 shows the HMPEG of the invention significantly reduces skin irritation caused by sodium acyl isethionate at low levels of addition (i.e., HMPEG: anionic weight ratio below 1:1).

Three day skin patch tests showed that a HMPEG, namely POE(200) glyceryl stearate, significantly reduced the skin irritation caused by sodium acyl isethionate, even at low levels of addition. As shown in FIG. 2, at a sodium acyl isethionate (SAI)/POE(200) glyceryl stearate weight ratio around 1:0.74 (equivalent to 20% POE(200) glyceryl stearate in the bar containing 27% sodium acyl isethionate), POE(200) glyceryl stearate reduced the skin irritation of a DEFI/betaine liquor significantly. In contrast, even at a SAI to PEG 8000 weight ratio as low as 1:1.67 (effectively 45% PEG 8000 in a bar with 27% SAI (formulation D, Table 2)), PEG 8000 made no measurable mildness contribution to the SAI/CAP betaine aqueous liquor.

We claim:

1. A bar composition comprising (a) 10% to 70% by weight of total composition of a surfactant system selected from the group consisting of anionic surfactants, nonionic surfactants other than the nonionic polymer surfactant of item (c) below, cationic surfactants, amphoteric surfactants and mixtures thereof, wherein the anionic surfactant comprises 50% or greater of the surfactant system, and wherein anionic comprises no more than about 60% by wt. of the total composition (b) 20% to 85% by wt. of the composition of a bar structurant selected from the group consisting of alkylene oxide components having a molecular weight of from about 2,000 to about 25,000; $C_8$–$C_{22}$ free fatty acids; $C_2$ to $C_{20}$ alkanols; paraffin waxes; water-soluble starches; and (c) 2 to 30% by wt. total composition of a polyalkylene glycol polymeric surfactant having the structure $$R_1—(OCH_2CH_2)_m—OH; \text{ or}$$

$$R_1—(OCH_2CH_2)_m—OR_2;$$

wherein:

m is greater than about 150;

$R_1$ and $R_2$ are independently selected from the group consisting of $C_2$ to $C_{60}$ linear or branched alkyl, acyls, aryls, alkylaryls, alkenyls and fat and oil derivatives thereof;

melting temperature of the structure is between 25°- and 85°-C.;

molecular weight of structure is between 3000 and 25,000;

and portion of $R_1$ and/or $R_2$ in each mole of the structure is between 2% and 30% by wt. of the structure;

wherein the ratio by weight total composition of polyalkylene nonionic polymer to anionic surfactant is between 1:1.5 to 1:10.

2. A composition according to claim 1 wherein surfactant system comprises anionic, amphoteric or mixtures thereof.

3. A composition according to claim 1, wherein surfactant comprises acyl isethionate and betaine.

4. A composition according to claim 1, wherein structurant (b) comprises 30% to 70% of the bar.

5. A composition according to claim 1, wherein molecular wt. of structurant (b) is 3,000 to 10,000.

6. A composition according to claim 1, wherein the molecular weight of (c) is between 4,000 to 15,000.

7. A composition according to claim 2, wherein the portion of ethylene oxide moiety per mole of (c) is between 85% wt. to 97% wt.

8. A composition according to claim 2, wherein the melting temperature of (c) is between 40° to 65° C.

9. A composition according to claim 2, wherein the weight ratio of (c) to anionic surfactant is between 1:3 and 1:7.

10. A composition according to claim 1, additionally comprising a polyol.

11. A composition according to claim 9, wherein said polyol is selected from the group consisting of ethylene glycol, propylene glycol, glycerol and mixtures thereof.

12. A composition according to claim 1, wherein $R_1$ and $R_2$ are $C_8$ to $C_{40}$ hydrophobic moieties.

13. A composition according to claim 1 wherein portion of $R_1$ and/or $R_2$ in each mole of the structure is between 3% and 15% by wt. of structure.

* * * * *

UNITED STATES PATENT AND TRADEMARK OFFICE

CERTIFICATE OF CORRECTION

PATENT NO. : 5,795,852

DATED : August 18, 1998

INVENTOR(S) : He et al.

It is certified that error appears in the above-indentified patent and that said Letters Patent is hereby corrected as shown below:

On the title page, item [54] and Column 1:
In the title change "SURFACING" to -- SURFACTANTS -- .

Signed and Sealed this

Second Day of February, 1999

*Attest:*

*Attesting Officer*

*Acting Commissioner of Patents and Trademarks*